US006101720A

United States Patent [19]

Jones

[11] Patent Number: 6,101,720

[45] Date of Patent: Aug. 15, 2000

[54] SPECIAL CAN OPENER

[76] Inventor: Benjamin C. Jones, 14832 Redcliff Dr., Noblesville, Ind. 46060

[21] Appl. No.: 09/062,884

[22] Filed: Apr. 20, 1998

[51] Int. Cl.[7] ..... B67B 7/00

[52] U.S. Cl. ..... 30/2; 30/400

[58] Field of Search ..... 30/1.5, 2, 300, 30/310, 294, 289, 400, 435

[56] References Cited

U.S. PATENT DOCUMENTS 1,959,378 5/1934 Magill ..... 30/2

2,271,308 1/1942 Ross ..... 30/1.5

5,740,612 4/1998 Takeshita et al. ..... 30/1.5

*Primary Examiner*—Douglas D. Watts

[57] ABSTRACT

A novel device especially useful in opening a tobacco can or the like which has an outer wrapper embracing the can's sidewall and lid flange. A primary force member, curved to have the curvature of a tobacco can, has a longitudinal cutting lug on its innerface; and an outward tab connected to the primary force member provides a tab for pushing the tool circumferentially while the tool is pressed against the outer wrapper of the can, thus achieving a circumferential slit of the can's wrapper.

1 Claim, 3 Drawing Sheets

SPECIAL CAN OPENER

I. FIELD OF THE INVENTION

The present invention relates to a can opener device, and more particularly to a can opener device of special form and for a special use and purpose.

More particularly, the invention provides a can opener device of special form and nature which is especially useful and convenient for the opening of a can having an extra wrapper which renders more conventional can openers not easily usable.

Still more particularly, the present invention provides a can opener for the special task of opening a paper-wrapped can commonly used in packaging tobacco.

II. PROBLEMS INHERENT AS TO OPENING CANS IN WHICH TOBACCO IS PACKAGED

Several inherent particulars render tobacco cans bothersome and awkward to open.

A major particular of difficulty of opening a tobacco can is that tobacco is commonly packaged in a sealed container, such that a conventional can opener is scarcely effective to use.

That is, over the sidewalls and lid of a tobacco can, the tobacco manufacturers wrap the assembly with a paper wrapper which completely ensheaths the circular junction of the can's sidewalls and lid flange. This practice is so widely used in the industry as an implied guarantor of freshness and quality that the wrapper now seems necessary even though the can and lid do themselves provide a substantial shield.

A problem of the lack of convenience and handiness is thus created for the purchaser because the can opener device must be able to reach down along the can's sidewall so that the cutting feature of the device need to cut only the wrapper which is of much easier cutting than the can's sidewall or lid flange.

Without a cutter of the present invention the user is forced to manually "feel" for the edge of a lid flange, but must use a fingernail or nailfile or the like to sever the wrapper sheathing.

III. SUMMARY OF THE INVENTION

In the preferred form of this invention, the can opener device provides a novel device especially useful in opening a tobacco can or the like which has an outer wrapper embracing the can's sidewall and lid flange.

The device is advantageously formed of unitary construction of two main parts. That is, it has a first portion having a longitudinal cutting rib, the first portion and the rib being formed to have the curvature of a tobacco can.

The second portion of the device is of no special configuration or nature, except that it does extend outwardly of the first portion to provide for the application of a manual force by the user to force the device in a circumferential path, as the user holds the device such that its first portion is engaging against the can's wrapper, that engagement being such that the cutting rib is positioned closely adjacent the lower edge of the can lid flange, so that as the user applies a radial inward force to the first main portion and a circumferential or tangential force to the second main portion the forced engagement of the device acts through the can's wrapper and against the can's lid flange to easily achieve a complete circular severance of the can's wrapper.

Other features and details are set forth herein.

IV. PRIOR ART CAPABILITY AND MOTIVATIONS, AS HELPING TO SHOW PATENTABILITY HERE

In hindsight consideration of the present invention to determine its inventive and novel nature, it is not only conceded but emphasized that the prior art had details usable in this invention, but only if the prior art had had the guidance of the present concepts of the present invention, details of both capability and motivation.

That is, it is emphasized that the prior art had or knew several particulars which individually and accumulatively help to show the non-obviousness of this combination invention. E.g., a. The prior art has had several types of can-cutting hand tools for at least several decades;

b. The prior art has made improvements in cutting tools, including developments of both manual tools and power driven appliances; but none has developed along the particular lines of the present concept;

c. The prior art has long realized that the procedure of installing a paper wrapper on tobacco cans has inherently required some effective means of severing the paper wrapper as a step of opening the can;

d. The problem of opening a tobacco can in spite of its tight paper wrapper has been a very personal problem, personally observed by millions of persons for all of the many years of tobacco can packaging;

e. It seems likely that many if not most users and manufacturers of canned tobacco products would have realized the need to provide an advantageous and novel can opener for this purpose;

f. The relative simplicity of can openers, as an item of construction, has surely given manufacturers ample incentive to have made modifications for commercial competitiveness in a competitive industry with huge sales prospects reasonably expectable;

g. The prior art has always had sufficient skill to make many types of can openers, more than ample skill to have achieved the present invention, but only if the concepts and their combinations had been conceived;

h. Substantially all of the operational characteristics and Advantages of details of the present invention, when considered separately from one another and when considered separately from the present invention's details and accomplishment of the details, are within the skill of persons of various arts, but only when considered away from the integrated and novel combination of concepts which by their cooperative combination achieves this advantageous invention;

i. The details of the present invention, when considered solely from the standpoint of construction, are relatively simple, and the matter of simplicity of construction has long been recognized as indicative of inventive creativity;

j. Similarly, and a long-recognized indication of inventiveness of a novel combination, is the realistic principle that a person of ordinary skill in the art, as illustrated with respect to the claimed combination as differing in the stated respects from the prior art both as to construction and concept, is that the person of ordinary skill in the art is presumed to be one who thinks along the line of conventional wisdom in the art and is not one who undertakes to innovate;

k. The prior art has long had mechanisms and production equipment of various kinds which could produce all of the particulars of the present invention;

l. The cost of manufacture of a one-piece can opener is sufficiently low as to be within the marketability or supposed-marketability in this aggressive industry;

m. Accordingly, although the prior art has had capability and motivation, amply sufficient to presumably give incentive to the development of specialized can openers according to the present invention, the fact remains that the present invention awaited the creativity and inventive discovery of the present inventor. In spite of ample motivation and capability shown by the illustrations herein, the prior art did not suggest this invention.

V. PRIOR ART FACTORS, AS PARTICULAR INSTANCES OF FAILURE TO ACHIEVE THE PRESENT CONCEPTS

In view of all of these factors of capability and motivation, it may be difficult to realize that the particular combination of the one-unit basic construction has not been conceived, even though the tool and appliance industry is quite commercial and competitive. Further, the persons of sufficient knowledge and skill to have achieved this combination surely include a multitude of manufacturers and users of can openers of various designs, such that this combination invention would have come about if its concepts had been obvious.

VI. SUMMARY OF THE PRIOR ART'S LACK OF SUGGESTIONS OF THE CONCEPTS OF THE INVENTION'S COMBINATION

In spite of all such factors of the prior art, the problem here solved awaited this inventor's present creativity. More particularly as to the novelty here of the invention as considered as a whole, the candid reference to the prior art uses and needs helps to show its contrast to the present concepts, and emphasizes the advantages, novelty, and the inventive significance of the present concepts as are here shown, particularly as to salability, characteristics of use, etc.

Moreover, prior art articles known to this inventor which could possibly be adapted for this duty fail to show or suggest the details of the present concepts as a combination; and a realistic consideration of the prior art's differences from the present concepts of the overall combination may more aptly be described as teaching away from the present invention's concepts, in contrast to suggesting them, even as to a hindsight attempt to perceive suggestions from a backward look into the prior art, especially since the prior art has long had much motivation as to details of the present invention and to its provisions.

And the existence of such prior art knowledge and related articles embodying such various features is not only conceded, it is emphasized; for as to the novelty here of the combination and of the invention as considered as a whole, a contrast to the prior art helps also to remind both the great variety of the various prior art articles and the needed attempts of improvement, and of the advantages and the inventive significance of the present concepts. Thus, as shown herein as a contrast to all the prior art, the inventive significance of the present concepts as a combination is emphasized and the nature of the concepts and their results can perhaps be easier understood.

Although varieties of prior art are conceded, and ample motivation is shown and full capability in the prior art is conceded, no prior art shows or suggests details of the overall combination of the present invention, as is the proper and accepted way of considering the inventiveness nature of the concepts.

That is, although the prior art may show an approach to the overall invention, it is determinatively significant that none of the prior art shows the novel and advantageous concepts in combination, which provides the merits of this invention, even though certain details are shown separately from this accomplishment as a combination.

And the prior art's lack of an invention of a combination device achieving the combination of economy, handiness and convenience in use, and other advantages of the present invention, which are goals only approached by the prior art, must be recognized as showing a long-felt need fulfilled.

Accordingly, the various concepts and components are conceded and emphasized to have been widely known in the prior art as to various devices; nevertheless, the prior art not having had the particular combination of concepts and details as here presented and shown in novel combination different from the prior art and its suggestions, even only a fair amount of realistic humility to avoid consideration of this invention improperly by hindsight, requires the concepts and achievements here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art.

VII. BRIEF DESCRIPTION OF THE DRAWINGS

The above description of the novel and advantageous invention is of somewhat introductory and generalized form. More particular details, concepts and features are set forth in the following and more detailed description of the preferred embodiment, taken in conjunction with the accompanying Drawings which are of somewhat schematic and diagrammatic nature for showing the inventive concepts.

Figure 4:
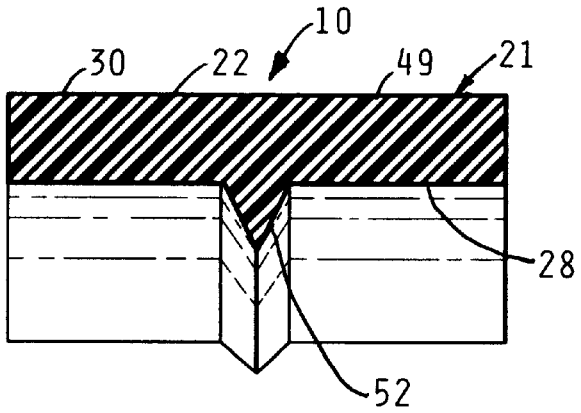

FIG. 4, in enlarged scale, is a cross-sectional view of the device; and

Figure 3:
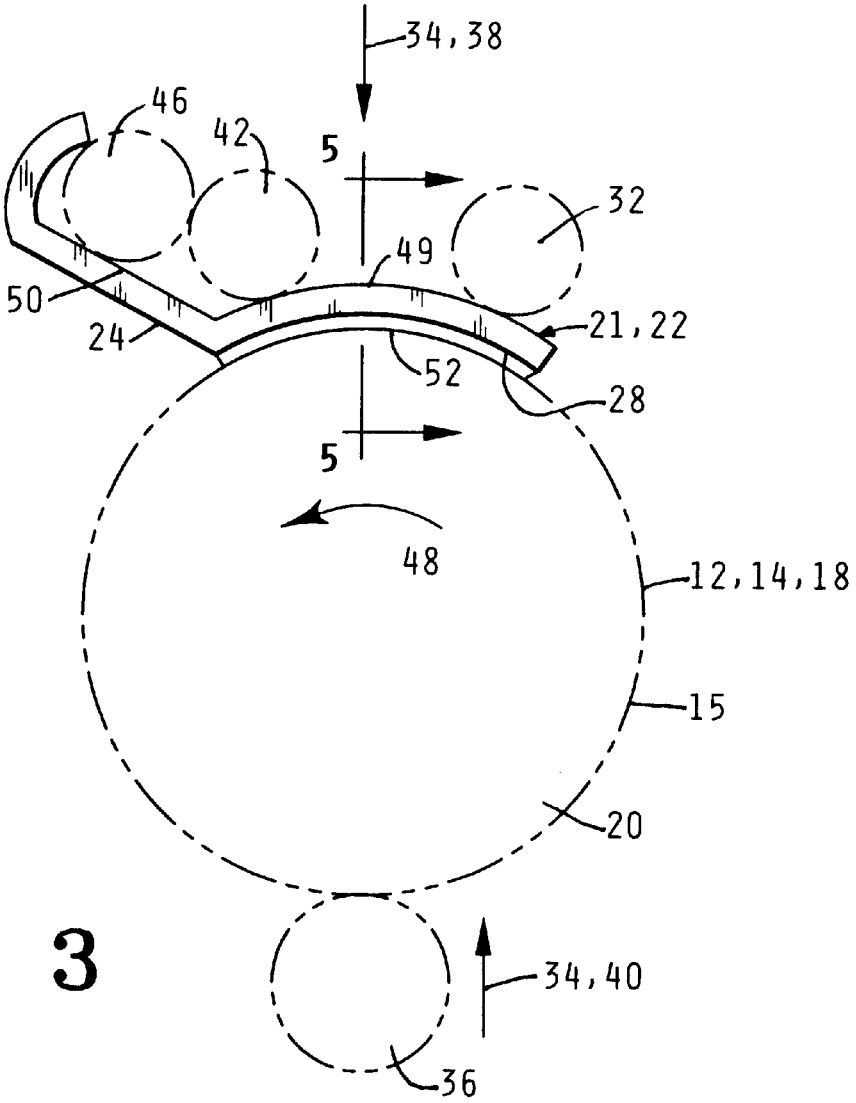
FIG. 3 is a plan view of the device shown in FIGS. 1 and 2 in the forceful procedure of severing the can's outer wrapper, the can being shown in chain lines, and with the user's thumb and fingers also shown in chain lines.
Figure 5:
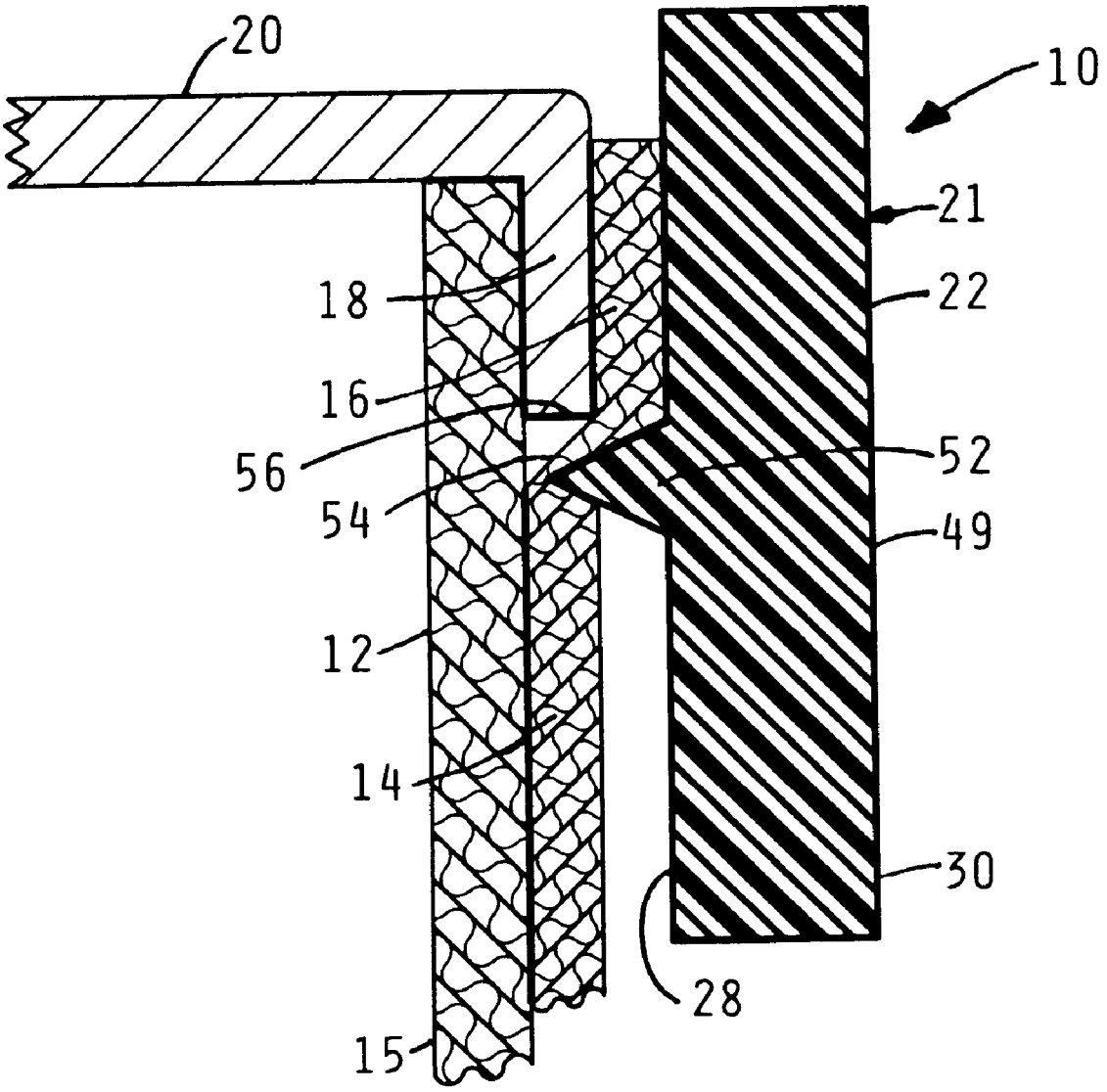

FIG. 5, in considerably enlarged scale, is a cross-Sectional detail view, generally as taken by Section line 5—5 of FIG. 3.

VIII. DETAILED DESCRIPTION OF PREFERRED EMBODIMENT

As illustrated in the Drawings, the inventive concepts provide a special can opener device 10, for a special use, i.e., the use in opening a can 12 having an outer wrapper 14 which embraces the can's sidewall 15 and extends upwardly (as at 16) over the axial flange 18 of the can lid 20, an assembly commonly used in packaging tobacco. (In the illustrative embodiment, the wrapper 14 is shown as extending fully around the can although the concepts are not limited to use with a wrapper of such full extent.)

The primary force member 21 of the device 10 has a first portion 22 and a second portion 24, and the first portion 22 of the primary force member 21 has a distinct curvature, i.e., its curvature is shown as being about the same as the curvature of the can 12's sidewall 15, and the function and purpose of the curvature is shown in the Drawings and as specified in the text herein.

It will be noted that the second portion 24 of the primary force member 21 extends outwardly from the first portion 22 of the primary force member 21, also as shown in the Drawings.

As distinct features of the first portion 22 of the primary force member 21, and as shown, it has an innerface 28 and an outerface 30; and as shown the outerface 30 of the first portion 22 of the primary force member 21 is open to accept the presence of the user's forefinger 32 and/or middlefinger 42 for its forceful engagement of the first portion 22 of the primary force member 21 by the user's forefinger 32 and/or middlefinger 42 caused by the user's thumb 36 while the primary force member 21 is being manually held against the can's sidewall 15, lid flange 18, and wrapper 14, in a holding manner so as to put gripping force 34 thereon by the user's forefinger 32 and/or middlefinger 42 caused by the the gripping force 34 being generally diametrically with respect to the associated can's sidewall 15, lid flange 18 and wrapper 14, as they are being gripped in a diametrically opposed manner between the user's forefinger 32 and/or middlefinger 42 and the user's thumb 36. This is best illustrated in FIG. 3, and with the diametrical force shown schematically by force arrows 38/40.

Figure 1:
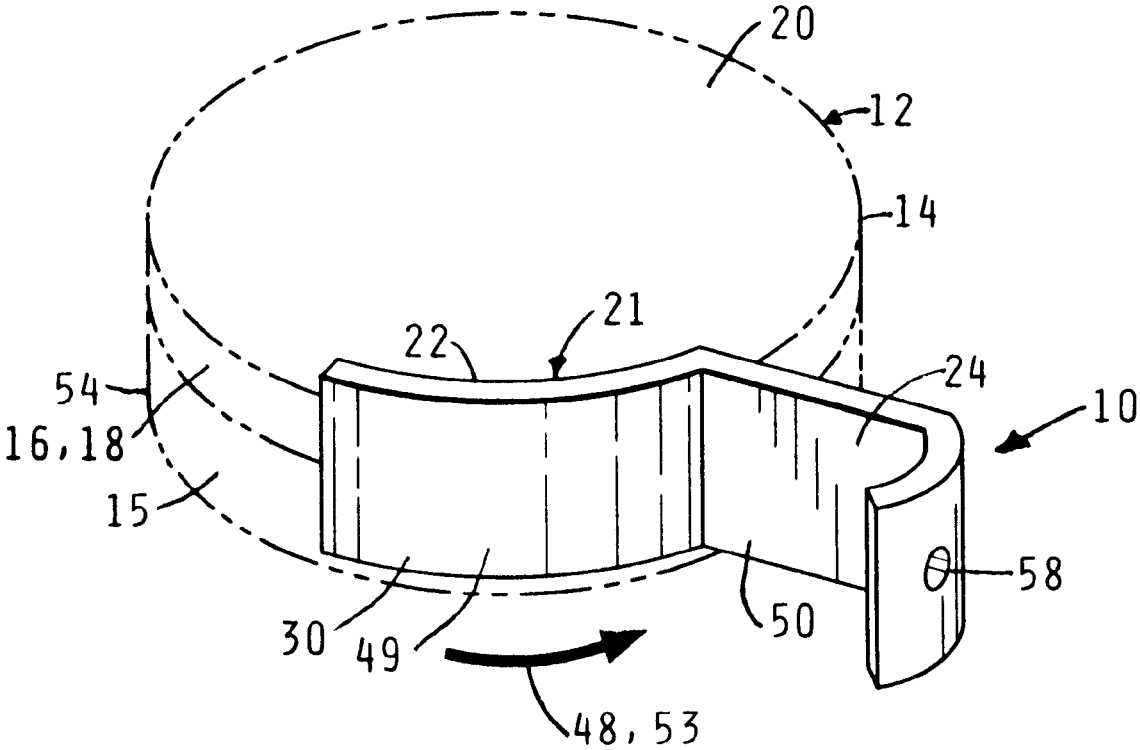
FIG. 1 is a pictorial representation of the special can opener device of the present invention, the device itself being shown in full lines as being applied to a container (shown in chain lines) whose outer wrapper is being severed according to the device and the procedure set forth herein.

As shown in FIGS. 1 and 3, the device 10's first portion 22 of its primary force member 21 has an only short length, shown as extending along only a portion of only one side 15 of the can, such that the user may manually apply the device 10 to the can 12's sidewall 15 in a holding manner and withdraw the device 10 therefrom, by relative movement generally perpendicularly to the axis of the can 12 toward and away from the associated can 12, without need of having to move the device 10 primarily axially of the can 12, and without need of any springiness of the first strip portion 22 to give a withdrawing effect to the device 10.

As to the second portion 24 of the primary force member 21, it is shown as being generally open to accept the presence of the user's and/or ringfinger 46 and/or middlefinger 42 and force (vector 48) from the user's ringfinger 46 and/or middlefinger 42 generally tangentially to the sidewall 15, lid flange 18 and wrapper 14 of the associated can 12.

More as relates to the various functions and features, the first portion 22 of the primary force member 21 is shown as providing a gripping area 49 for application of a can-gripping force 38/40 extending between the user's forefinger 32 and/or middlefinger 42 caused by the thumb 36 as the user makes a fist-forming action; moreover, the second portion 24 of the primary force member 21 provides an area 50 for application of ringfinger 46 and/or middlefinger 42 of a generally tangential force 48 which causes movement of the primary force member 21 in a tangential manner with respect to the can 12.

For providing the actual cutting action of the wrapper 14, the first portion 22 of the primary force member 21 is shown as carrying on its innerface 28 a sharp lug means 52 adapted to cut the can's wrapper 14 in the region (16) thereof which overlies both the sidewall 15 of the can 12 and the adjacent axial portion of the can's lid flange 18, as shown in FIG. 5.

Advantageously, the sharp lug means 52 is provided as an integral formation of the first portion 22 of the primary force member 21, extending longitudinally of the first portion 22 of the primary force member 21.

Advantageously providing the features of the first portion 22 of primary force member 21, it is shown as inwardly concave and outwardly convex.

Correspondingly providing features as shown, the first portion 22 of the primary force member 21 and the second portion 24 of the primary force member 21 are close enough together such that (FIG. 3) when the user is gripping (force ventor 38/40) the associated can 12 between the user's forefinger 32 and/or middlefinger 42 and thumb 36, the user's middlefinger 42 is positioned between the user's forefinger 32 and ringfinger 46 such that the user's middlefinger 42 applies both a diametrical force 38/40 toward the can 12 and a tangential force 48 for assisting the ringfinger 46 in causing the primary force member 21 to move tangentially of the can 12, the slit 54 of wrapper 14 being progressively achieved as the primary force member 21 is moved circumferentially around the can 12 as indicated by the movement arrow 53 in FIG. 1 and by the intermediate chain line 54, that slit 54 being shown in FIG. 5 by the cutting rib 52 being forced to sever the wrapper 14 in its portion 16 adjacent the lower edge 56 of the can lid flange 18.

Figure 2:
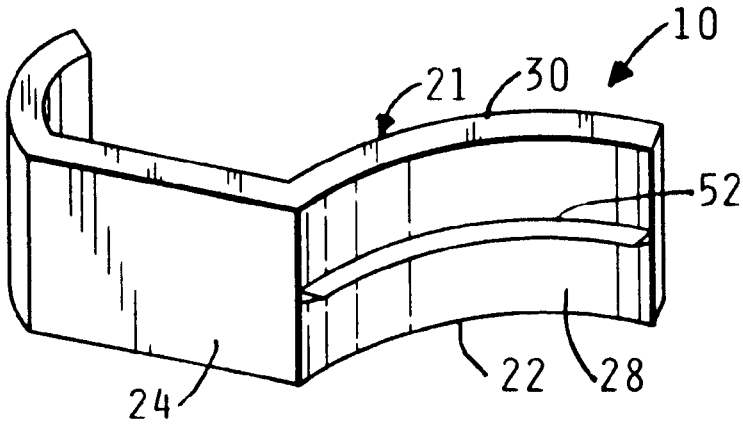
FIG. 2 is a pictorial view of the device as shown in FIG. 1, as would be seen looking outwardly onto the innerface of the device.

As indicated in FIGS. 2 and 4, and more especially in FIG. 5, another concept is that the first portion 22 of the primary force member 21 is sufficiently wide (high as shown in FIGS. 1,2 and 5) that the lug means 52 is positioned thereon relative to the width of the first portion 22 of the primary force member 21, when the primary force member 21 is positioned adjacent the can 12 with the upper edge of the first portion 22 of the primary force member 21 in a position adjacent to or above the can lid 20, such that the lug means 52 is positioned below the lower edge 56 of the lid flange 18 regardless of whether the primary force member 21 is positioned such that the second portion 24 of the primary force member 21 is positioned to accept tangential force (vector 53) in a counterclockwise direction (as shown in FIGS. 1,2 and 3) or, if the device 10 is turned over, to accept tangential force (vector 53) against the second portion 24 of the primary force member 21 in a clockwise direction. This gives the extra advantage of the same device 10 being usable by either a right handed person or a left handed person; and it is shown attained in the preferred embodiment by making the lug means 52 to be positioned about midway of the width of the first portion 22 of the primary force member 21.

As an extra feature of advantage, the out-turned nature of the second portion 24 of the primary force member 21 provides an optional supplemental use of the device's primary force member 21 as being a holder for a keychain, giving a combination advantage of joint use of the device, i.e., as a special can opener device or as a keychain tab. A hole 58 in that tab component 24 facilitates assembly of a keychain onto the device.

In use of achieving the slit 54, the device 10 is manually forced circumferentially of the can 12 and its wrapper 14, preferably with the user guiding the device 10 in a manner such that the lower edge 56 of the can's lid flange 18 serves as a template, automatically causing the slit 54 to be at the same height of the can 12 throughout the full circumferential extent of the slit 54, achieving an attractive orderliness of the can 12 and its lid flange 18 so that the user would not necessarily have to bother to physically remove the severed portion 16 of the wrapper 14.

IX. CONCLUSIONS AS TO INVENTIVE COMBINATION

It is thus seen that a special can opener, formed according to the combination of inventive concepts and details herein set forth, provides novel concepts of a desirable and usefully advantageous article, yielding advantages which are and which provide special and particular advantages when used for a can opener particularly advantageous for opening a can having an outer wrapper which must be slit in order to release the can lid, particularly as tobacco is conventionally packaged.

In summary as to the nature of the overall can opener's advantageous concepts, their novelty and inventive combination is shown by novel features of concept and procedure shown here in advantageous combination and by the novel combinations hereof not only being different from all prior art known, even though many other can openers of conventional and specialized types have been known and used for scores of years, but because the achievement is not what is or has been suggested to those of ordinary skill in the art, especially realistically considering this as a novel combination comprising components which individually are similar in nature to what is well known to most all persons, surely including most of the many makers and users of can openers for a great number of years throughout the entire world. No prior art component or element has even suggested the modifications of any other prior art to achieve the particulars of the novel concepts of the overall combination here achieved, with the special advantages which the overall combination article provides; and this lack of suggestion by any prior art has been in spite of the long worldwide use of various types of can openers.

The differences of concept, of construction and procedure, yield advantages over the prior art; and the lack of this invention by the prior art, as an inventive combiantion, has been in spite of this invention's apparent simplicity of the construction once the concepts have been conceived, in spite of the advantages it would have given, and in spite of the availability of all of the materials to all persons of the entire world, and the invention's relatively non-technical and openly-visible nature.

Quite certainly this particular combination of prior art details as here presented in this overall combination has not been suggested by the prior art, this achievement in its particular details and utility being a substantial and advantageous departure from prior art, even though the prior art has had somewhat similar components separately for numbers of years.

Particularly is the overall difference from the prior art significant when the non-obviousness is viewed by a consideration of the subject matter of this overall device as a whole, as a combination integrally incorporating features different in their combination from the prior art, in contrast 19. to merely separate details themselves, and further in view of the prior art of can opener articles not achieving particular advantages here achieved by this combination.

Accordingly, it will thus be seen from the foregoing description of the invention according to the illustrative embodiment, considered with the accompanying Drawings, that the present invention provides new and useful concepts of a novel and advantageous article, possessing and yielding desired advantages and characteristics in formation and use, and accomplishing the intended objects including those hereinbefore pointed out and others which are inherent in the invention.

Modifications and variations may be effected without departing from the scope of the novel concepts of the invention; accordingly, the invention is not limited to the specific embodiment, or form or arrangement of parts herein described or shown.

What is claimed is:

1. A tobacco can opener device, for use in opening a tobacco can by slitting the can's outer wrapper, the wrapper embracing the associated can and be standing over the end edge of the (axial flange of the can) can's lid, the lid's end being formed downward over the top of the can so that the can's lid will remain on the can after the slitting of the wrapper the device comprising a force member having a first portion and a second portion, the first portion of the force member having a curvature, the curvature being about the same as the curvature of the sidewall of the associated can, the first portion of the force member being so dimensioned such that said first portion has a hart length, providing that when embracing the can the first portion would extend along only a portion less than 180° of only one side of the can providing that a user may manually apply the device to the can by relative movement generally perpendicularly to the axis of the can, toward and away from the associated can, and the second portion of the force member extending outwardly from the first port ion of the force member, away from the associated can to provide a tangential force around the associated can, the first portion of the force member having an innerface and an outerface, the outerface of the first portion of the force member being open to accept the presence of the user's forefinger and/or middlefinger for forceful engagement of the first portion of the force member which causes the innerface of the force member to be manually held against the can's wrapper, sidewall, and the lid's end in a holding manner so as to put gripping force thereon by the user's for finger and/or middlefinger opposed by the user's thumb, the gripping force being generally diametrically across the can with respect to the associated can's sidewall, lid and wrapper, rather than off to the side of the can, the second portion of the force member being generally open also to accept the presence of the user's ringfinger and/or middlefinger and force from the user's ringfinger and/or middlefinger generally tangentially to the sidewall, lid and wrapper of the associated can, the first portion of the force member carrying on its innerface a sharp lug means adapted to slit the can's wrapper below the top of the can and below the downwardly formed portion of the end edge of the can's lid, the lug means being so short, that when the innerface of the first portion is held against the wrapper, the lug means would extend away from the first portion's innerface and toward the can's sidewall, only a distance less than to the location of the outer surface of the can's sidewall.

* * * * *